US010470549B2

(12) United States Patent
Weigel

(10) Patent No.: US 10,470,549 B2
(45) Date of Patent: Nov. 12, 2019

(54) WIPER HAVING HINGED WIPER ARMS

(71) Applicant: GEKA GmbH, Bechhofen (DE)

(72) Inventor: Friedrich Weigel, Wittelshofen (DE)

(73) Assignee: GEKA GmbH, Bechhofen (DE)

( * ) Notice: Subject to any disclaimer, the term of this patent is extended or adjusted under 35 U.S.C. 154(b) by 312 days.

(21) Appl. No.: 15/502,319

(22) PCT Filed: Aug. 5, 2015

(86) PCT No.: PCT/EP2015/068089
§ 371 (c)(1),
(2) Date: Jul. 5, 2017

(87) PCT Pub. No.: WO2016/020452
PCT Pub. Date: Feb. 11, 2016

(65) Prior Publication Data

US 2017/0303659 A1 Oct. 26, 2017

(30) Foreign Application Priority Data

Aug. 7, 2014 (DE) ..... 20 2014 103 676 U

(51) Int. Cl.
*A45D 34/04* (2006.01)
*A45D 40/26* (2006.01)

(52) U.S. Cl.
CPC ..... *A45D 34/046* (2013.01); *A45D 40/267* (2013.01)

(58) Field of Classification Search
CPC .. A45D 34/046; A45D 40/267; A45D 34/047; A45D 34/045; A45D 40/268; A45D 40/265
See application file for complete search history.

(56) References Cited

U.S. PATENT DOCUMENTS

| | | | | |
|---|---|---|---|---|
| 2,703,898 | A | 3/1955 | Kellett | |
| 3,558,022 | A * | 1/1971 | Zytko | B65D 55/04 222/490 |
| 5,697,720 | A | 12/1997 | Lhuisset | |
| 6,010,265 | A | 1/2000 | Bouix | |
| 6,676,320 | B1 * | 1/2004 | Wainer | A46B 9/021 401/121 |
| 2005/0095052 | A1 | 5/2005 | Wainer | |
| 2005/0220528 | A1 | 10/2005 | Petit | |

FOREIGN PATENT DOCUMENTS

DE 202011051676 1/2013

* cited by examiner

*Primary Examiner* — David J Walczak

(57) ABSTRACT

A wiper for wiping a cosmetic applicator, having a first component, in particular a holding section, for fastening the wiper to a cosmetic reservoir, and at least two wiper arms arranged thereon and exhibiting wiping action. The invention aims to provide a wiper, in which the intensity of the wiping and the resistance with which the wiper opposes the withdrawal of the applicator and the actual applicator section are in a favourable ratio to one another, and an actuation from outside in order to achieve a change to the distal diameter of the wiper inside the applicator container is not necessary. This aim is achieved in that at least one of the wiper arms is fastened by means of at least one hinge to the first component, in particular the holding section.

12 Claims, 5 Drawing Sheets

WIPER HAVING HINGED WIPER ARMS

FIELD OF THE INVENTION

The invention is directed to wipers for wiping off a cosmetics applicator, with a first component, in particular a retaining portion, for fixing the wiper to a cosmetics storage container, and at least two wiper arms that are disposed thereon and exert a wiping action.

The invention is further directed to a method for manufacturing such a wiper.

Finally, the invention is directed to a cosmetics unit with a cosmetics storage container, an applicator, a closure cap and a wiper, which is mounted in the neck or the removal opening of the cosmetics storage container, for wiping off cosmetic mass from the applicator.

BACKGROUND OF THE INVENTION

Such a wiper serves for wiping off excess cosmetic mass from an applicator that has been dipped into the cosmetic mass and is then withdrawn from the cosmetics supply through the wiper, in order to apply a certain amount of the cosmetic, preferably without any dripping. In particular, the invention relates to a wiper for lip gloss or mascara mass applicators. Generally, such an applicator consists of an actual applicator portion, which is attached to its one end and frequently configured as a bristle covering, and an applicator handling means attached to its opposite end, in which the applicator handle is frequently configured as a screw cap at the same time. The applicator portion and the applicator handling means are connected to an applicator stem which, if disposed in an applicator container or cosmetics storage container containing the supply of cosmetic mass, is positioned so as to be movable in the center of the wiper inserted into the mouth of the applicator container or cosmetics storage container.

Various designs of applicators have become known in the prior art. Such wipers are most frequently configured as sleeves or tubular bodies that taper at one end in the manner of a truncated cone, in the broadest sense. The portion configured like a truncated cone forms a wiper hp which extends peripherally in the circumferential direction, is most frequently closed in itself or subdivided into closely adjacent circle segments that each form a wiper arm.

When dimensioning such a wiper lip, considerable attention has to be paid with regard to the diameter of the stem with which the actual applicator portion, which predominantly consists of a bristle covering, is connected to the applicator handle.

A conflict of objectives is often the result especially if applicators with a bristle covering are used. If the clear internal diameter of the wiper lip of such a wiper is dimensioned to be comparatively large, the wiper does not put up any excessive resistance when the applicator is withdrawn, but leaves a lot of cosmetic mass in the applicator or in its bristle covering.

Once the clear diameter of the area enclosed by the wiper lip is made considerably smaller than the diameter of the applicator stem, the actual applicator portion is wiped off to a considerably greater extent. However, the resistance that has to be overcome when the applicator is withdrawn is increased significantly at the same time.

In many cases, this conflict of objectives leads to the necessity, with regard to the design of the applicator, of having to maintain a certain diameter ratio between the applicator stem and the core of the applicator carrying the bristles, which limits the design options.

US 2005/0095052 A1 already discloses a wiper comprising a solid retaining portion to be fixed in a mouth opening of an applicator container, with a flexible wiper arm that is attached thereto by molding and forms a circle segment. The flexible wiper arm can be moved in such a way by means of an operating means that the distal diameter of the wiper inside the applicator container can be varied thereby. This is disadvantageous in that the flexible wiper arm has to be operated from the outside.

SUMMARY OF THE INVENTION

The invention is based on the object of creating a solution that provides a wiper in which the intensity of wiping and the resistance that the wiper puts up against the withdrawal of the applicator and the actual applicator portion are favorably balanced and in which an operation from the outside is not necessary for achieving a change of the distal diameter of the wiper inside the applicator container.

In a wiper of the type referred to in more detail in the introduction, this object is achieved, according to the invention, by at least one of the wiper arms being attached to the first component, in particular the retaining portion, by means of at least one hinge.

Further, the object is achieved by a method according to the invention.

This object is also achieved by a cosmetics unit with a cosmetics storage container, an applicator, a closure cap and a wiper (1), which is mounted in the neck or the removal opening of the cosmetics storage container, for wiping off cosmetic mass from the applicator.

Consequently, the object is achieved by a wiper for wiping off a cosmetics applicator configured as follows:

The wiper has a first component, most frequently in the form of a retaining portion, for fixing the wiper to a cosmetics storage container. In this case, the wiper has at least two wiper arms exerting a wiping action. At least one of the wiper arms is attached by means of at least one hinge to the first component of the wiper or the retaining portion of the wiper so as to be pivotable relative thereto.

The hinge axis, i.e. the pivot axis, generally constitutes a straight line which, if projected into the plane in which the longitudinal axis L lies, extends orthogonally to the longitudinal axis.

Since the specific design of the wiper arms is, at first, not critical for the attachment by means of the hinge, which is essential to the invention, the term "wiper arm" is to be construed broadly and describes any hinge-connected strip, portion or wall portion of the wiper hinge-connected to a wiper component, unless stated differently later on in the description by recognizably discussing a wiper arm in the narrower sense. Even within the context of this broad interpretation does the term "wiper arm" in no case refer only to the actual wiper lip, which protrudes as a thin portion from the actual wiper body, but rather preferably to a component of the actual wiper body, which is most frequently inclined by less than 12.5° relative to the longitudinal axis, which carries, at its distal end or in the third directly adjacent to its distal end, a part of the wiper lip, which may possibly extend inwards in a more oblique degree, and only constitutes a part of the wiper circumference.

The attachment by means of a hinge has the great advantage that the wiper arms can be specifically designed so as to be able to pivot outwards in a defined manner under the influence of the forces arising as intended during the application and that the maximum force that acts on the bristle covering when the applicator is moved through the wiper can be limited thereby. This is of importance particularly if the wiper is to cooperate with an applicator carrying a covering of injection-molded bristles, which are in danger of possibly being damaged by a wiping process that is carried out all too brusquely. In addition, such a wiper is able to cope with a greater spectrum of diameters of possible applicators and is thus able to cooperate with a considerably larger number of applicators with different diameters, whose diameters vary to a considerably greater extent than the spectrum of diameters of the "standard" applicators that match a prescribed standard wiper.

The size of the resistance that a wiper arm hinge-connected according to the invention puts up against it being pressed outwards can already be set with sufficient accuracy and in a simple manner in many cases by suitably dimensioning the hinge, in any case if an integral hinge is used that is integrated as a specially configured component into the wall area of a wiper arm.

For reasons predominantly involving patent law, it is noted that the at least, one hinge—even if this is not preferred for reasons of economization—as a classical hinge could consist of a hinge and pin or an axis and a claw attached, e.g., by clipping, wherein in that case, a spring member has to be provided of course, which presses the wiper arm hinge-connected in this manner into its position ready for wiping.

However, the integral configuration of the hinge, as it is described in More detail in connection with the exemplary embodiments, is clean preferred.

The following must be remarked with respect to the question of the definition of the term "hinge":

A wiper component shown in FIG. 7 in the form of a bending beam or projection 10' without a local thin portion, which is uniformly or largely uniformly (+/−25%) deformed over its entire length with the radius RK, does not have a hinge or is not attached by means of an integral hinge.

In the broadest sense, the term hinge in the sense of the invention, in particular an integral hinge, means that an area exists that provides for the predominant part of the deformation that contributes to the hinge-connected wiper arm or a projection being displaced outwards under the influence of the forces arising as intended during application. In this respect, reference is made to FIG. 8, which shows that the predominant part of the deformation resulting in the displacement in the radially outward direction of the wiper arm carrying a projection is provided by the thin portion, which is clearly recognizable. Under the influence of bending, such an area most frequently exhibits a local radius of curvature that is smaller at least by the factor 5 than the radius of curvature of the directly adjacent wall areas of the wiper, which are possibly also deformed under the load, in each case relative to an axis perpendicular to the longitudinal axis L.

It must also be remarked that what is illustrated by way of example in the FIGS. 7 and 8 using the optional projection also applies to the wiper arms according to the invention.

Preferably, the at least one hinge is a local thin portion. Viewed in the direction of the longitudinal axis, wall portions of the wiper that are thicker by the factor 3 are thus adjacent to both sides of the thin portion. In an embodiment, the invention is therefore characterized in that the at least one hinge is configured in the form of a local thin portion.

It is particularly beneficial if the at least one hinge is, a film hinge whose thickness is ideally in the sub-millimeter range. Therefore, the invention also provides that the at least one hinge is provided in the form of a film hinge.

Particularly preferably, each of the wiper arms is joint-connected to the retaining portion with only a single hinge, wherein the hinge, relative to the extent of the wiper arm in the circumferential direction, is preferably disposed centrally on the wiper arm. A single, preferably centrally positioned hinge does not put up any resistance that is too large to the desired outward pivoting of the wiper arm, even when the wiper arm, in the circumferential direction, has a curvature that is not negligible and the bending stiffness associated therewith. In another embodiment, the invention is therefore also characterized in that each of the wiper arms is joint-connected to the first component, in particular retaining portion, by means of only a single hinge, wherein the respective hinge, relative to the extent of the respectively associated wiper arm in the circumferential direction, is preferably disposed centrally on the respective wiper arm.

It was found to be ideal if at least one additional spring member is associated with the at least one hinge. In an advantageous embodiment, the invention therefore also provides that at least one spring member, which presses the respective wiper arm in the direction of its closed position, is associated with the at least one hinge, preferably with all hinges.

In rare cases this spring member—contrary to its name—may functionally be a further component of the hinge, so that the spring member will exhibit less of a spring action and primarily define the pivot axis together with the actual hinge. However, this is not preferred.

Generally, this spring member has a stand-alone function independent from the hinge, i.e. a stabilizing function. It is generally designed so as to increase the resistance that the respective wiper arm puts up against it being pushed outwards ideally, the spring member presses the respective wiper arm in the direction of its closed position, i.e. in the direction (closer) towards the longitudinal axis L.

It is not mandatory, but ideally, the spring member(s) are even designed in such a way that they have the stem portion of projection of a respective wiper arm associated with them snap back into its intended position automatically or under the influence of small external forces after demolding. Then, they even contribute to completing the wiper.

In any case, it is possible, using the spring members, to set more accurately the resistance that a respective wiper arm puts up against it, being pivoted outwards.

Preferably, an elastic strip is used as a spring member, which—relative to the longitudinal wiper axis—is linked to the retaining portion in front of the hinge and, behind the hinge, to the wiper arm. Such a spring member is typically integrally injection-molded together with the rest of the wiper in a single shot. Therefore, the invention further provides that the at least one spring member is an elastic strip, which, relative to the longitudinal wiper axis and in the direction towards the distal end of the wiper, is in each case linked to the retaining portion in front of the at least one hinge, preferably of all hinges, and, behind the respective hinge, to the wiper arm.

It was found to be beneficial if the spring member has a preferably constant curvature whose center of curvature is situated between it and the longitudinal wiper axis. If the curvature is continuously variable, this applies to all its centers of curvature. In this respect, an embodiment of the invention provides that the at least one spring member has an, in particular constant or continuous, curvature whose center of curvature or centers of curvature is/are situated between the at least one spring member and the longitudinal wiper axis.

Most frequently, a hinge which, viewed in the circumferential direction, is centrally situated is provided preferably on one, preferably on each, wiper arm, and two spring members which, viewed in the circumferential direction, are disposed on both sides next to the hinge. Therefore, the invention is further characterized in that a hinge which, viewed in the circumferential direction, is centrally situated, is provided on one, preferably on each, wiper arm, and, viewed in the circumferential direction, one spring member, respectively, is disposed on both sides next to the respective hinge.

Optimally, the wiper(s) is/are designed in such a way that its/their hinges and preferably also the optionally associated spring members permit pivoting at least one, and preferably all, wiper arms about the above-mentioned axis, namely over an angle of at least 90° relative to the longitudinal axis. This is understood to mean an angle of exactly 90° or, if applicable, with a tolerance of +/−15°. Finally, the invention consequently also provides that at least one, preferably all, wiper arms are configured so that they can be folded outwards over an angle of at least 90° relative to the longitudinal axis.

The wiper arms molded onto a retaining portion may be configured differently. One variant of a wiper arm may have a ring portion on its bottom edge. In an embodiment, the invention is therefore further characterized in that at least a part, preferably half, of all wiper arms, in particular alternately every second wiper arm in the circumferential direction of the retaining portion, has a stem portion with a ring portion, whose extent in the circumferential direction is greater than the extent of the stem portion, molded onto its distal end.

Particularly suitable production methods for a wiper according to the invention include plastic injection molding and 3D printing or rapid prototyping methods processing plastic. In another embodiment, the invention therefore also provides that the wiper is produced by means, of injection molding or by means of a 3D printing method.

For producing the wiper according to the invention, a method is suitable for injection-molding a wiper which consists of at least two portions that are connected to each other by means of an integral hinge, wherein the portions are injection-molded in a folded-out position that does not correspond to the position that they assume relative to each other during the intended use of the finished wiper, and that, automatically or by means of external forces, the portions pivot into the position relative to each other that they assume relative to each other during the intended use of the finished wiper when free from load, after the wiper has been demolded. In order to be able to produce the wiper by injection molding in a position that is more easily manageable for the purpose of injection molding, but which does not correspond to the overall positioning of all components of the wiper relative to each other in a state ready for use and free from load, the use and configuration of a hinge or of several hinges is in this case useful and advantageous. This enables a method for producing a wiper having a first component, in particular a retaining portion, for fixing the wiper to a cosmetics storage container, and at least two wiper arms that exert a wiping action, by means of injection molding in such a way that, on the one hand, the at least two wiper arms exerting a wiping action and, on the other hand, the first component, in particular the retaining portion, are injection-molded in a folded-out position relative to each other, which does not correspond to the position that the first component, in particular the retaining portion, and the at least two wiper arms exerting a wiping action assume relative to each other during the intended use of the wiper, wherein the at least two wiper arms exerting a wiping action are each connected to the first component, in particular the retaining portion, by means of at least one hinge, and that the at least two wiper arms exerting a wiping action, after demolding the wiper from the injection-molding tool, pivot or are pivoted preferably automatically, relative to each other and to the first component, in particular the retaining portion, into the position that they assume relative to each other during the intended use of the wiper when free from load, which is also provided by the invention in an embodiment.

However, what is also possible is a method for injection-molding a wiper consisting of at least two portions connected to each other by means of an integral hinge, in which the portions are injection-molded in a position corresponding to their position on the finished applicator during intended use, wherein the hinges are used for being able to move the hinge-connected portion relative to the other portion during demolding from the injection-molding tool and thus facilitate or enable demolding. Alternatively, it is therefore also possible to injection-mold the wiper in an embodiment in which its individual components, relative to each other, at least approximately already assume their use positions relative to each other. In this respect, the invention provides an alternative production method in another embodiment. This relates to a method for producing a wiper having a first component, in particular a retaining portion, for fixing the wiper to a cosmetics storage container, and at least two wiper arms that exert a wiping action, by means of injection molding in such a way that, on the one hand, the at least two wiper arms exerting a wiping action and, on the other hand, the first component, in particular the retaining portion, are injection-molded in a position relative to each other which at least substantially corresponds to the position that the first component, in particular the retaining portion, and the at least two wiper arms exerting a wiping action assume relative to each other during the intended use of the wiper, wherein the at least two wiper arms exerting a wiping action are each connected to the first component, in particular the retaining portion, by means of at least one hinge, and the hinges enable at least a slight pivoting of the respectively hinge-connected or joint-connected wiper arm during the demolding of the wiper from the injection-molding tool.

As an alternative to injection molding, the applicator according to the invention may be produced by 3D printing, i.e. by means of the methods that were developed for rapid prototyping.

Further modes of operation, advantages and optional embodiments become apparent from the following description of two specific exemplary embodiments with reference to the drawings.

DETAILED DESCRIPTION OF THE INVENTION

It has to be noted in advance that the wipers according to the invention are preferably used as wipers for mascara mass. Ideally, each of the wipers according to the invention forms a cosmetics unit together with a cosmetics storage container and a suitable applicator as well as a closure cap. In this case, the wiper according to the invention is inserted into the bottle neck or the container removal opening in such a way that its wiper arms protrude away from the container neck or the removal opening into the interior of the cosmetics storage container.

Then, it must be noted as generally valid that the term "distal" refers to the side of the wiper protruding the farthest into the interior of a cosmetics storage container in the longitudinal direction, whereas the term "proximal" refers to the side of the wiper closest in the longitudinal direction to the edge of the removal opening of the cosmetics container or cosmetics storage container.

Figure 1:
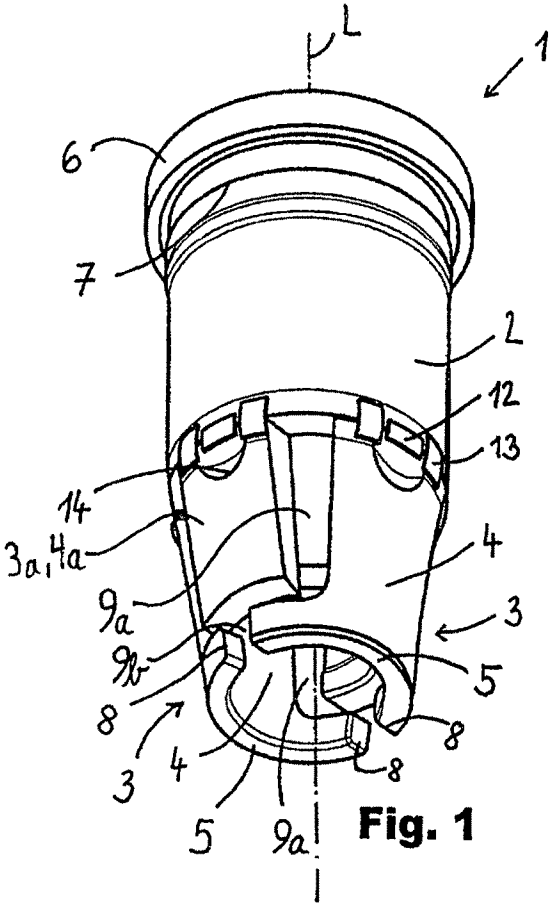
FIG. 1 shows a first exemplary embodiment of the wiper according to the invention in a perspective side view and magnified several times.

FIG. 1 offers the fastest overview of the hinge mechanism of the wiper 1 according to the invention.

As can be seen, the wiper 1 consists of a retaining portion 2 and at least two, in the exemplary embodiment precisely two, first wiper arms 3, which in turn comprise a first stem portion 4 and a ring portion 5 disposed thereon. Furthermore, second wiper arms 3*a* are formed in each case between two first wiper arms 3 in the circumferential direction of the retaining portion 2, which is configured to be substantially rotationally symmetric, and cylindrical in the exemplary embodiment. The second wiper arms 3*a* each have a second stem portion 4*a*. While a ring portion 5 is molded onto each of the first stem portions 4, such a portion is lacking in the second stem portions 4*a*, The second stem portions 4*a* of the second wiper arms 3*a* each fit into a window 9*a* respectively extending between two first stem portions 4 of the first wiper arms 3 and above a ring arm 8 of the ring portions 5. Generally, the retaining portion 2 has a substantially (except for tolerances) cylindrical shape and is most frequently completely closed in itself in the circumferential direction. With its middle or center, the retaining portion 2 defines the central longitudinal wiper axis L.

As was noted in the introduction, the term "wiper arm" is to be construed broadly, unless stated differently later on in the description by recognizably discussing a wiper arm in the narrower sense.

Figure 5A:
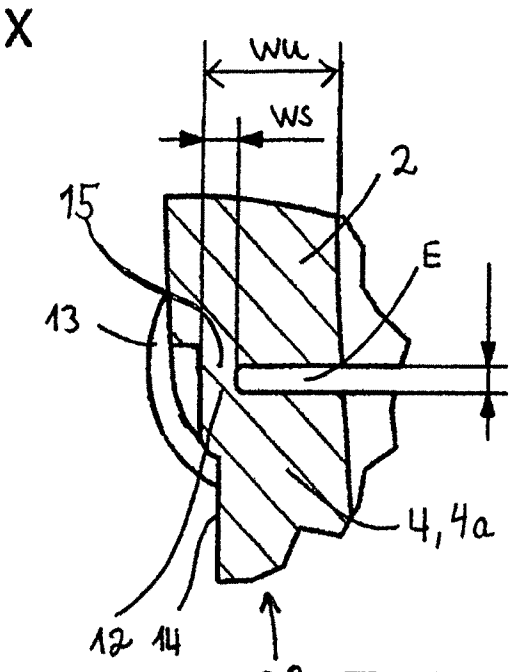
FIG. 5*a* shows a detail from, FIG. 5 in the area of a hinge 12, enlarged even further.

At first, the hinges 12 according to the invention require a closer consideration. FIG. 1 affords the best overview of these hinges 12, while the details of the hinges can best be recognized in FIGS. 5 and 5*a*.

Figure 5:
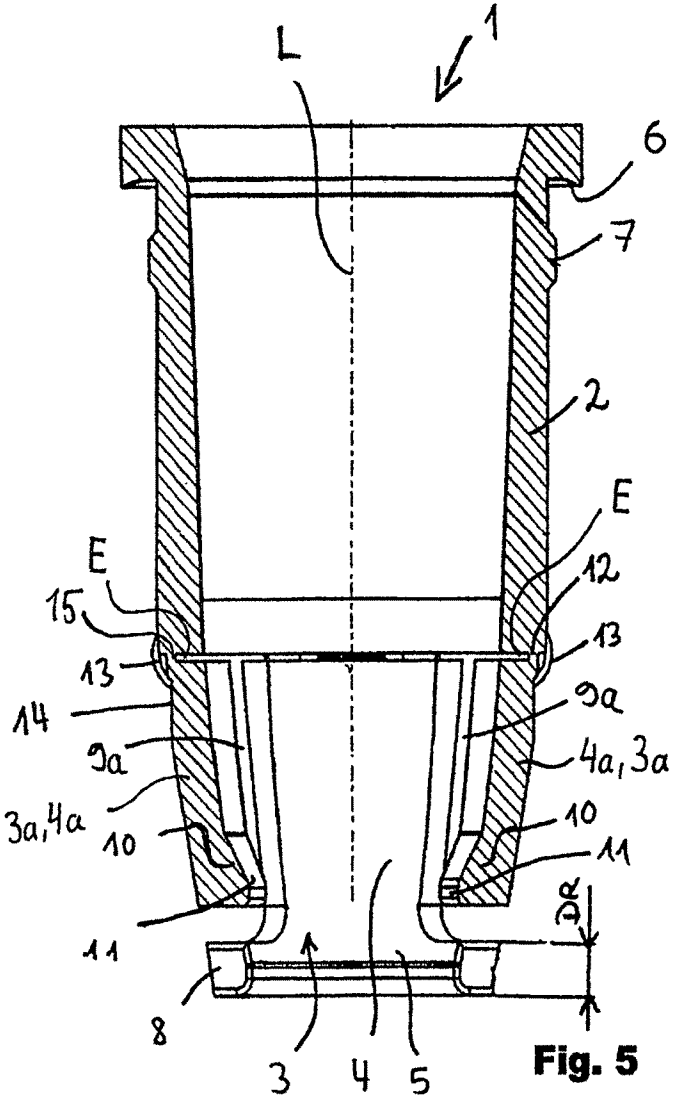
FIG. 5 shows a central longitudinal section of the wiper according to FIG. 1.

The integral configuration of the hinge as shown in FIG. 5 is clearly preferred over all other types of hinge.

In this case: the configuration as a film hinge is selected with preference. Most frequently, such a film hinge is designed in such a way that it forms a local thin portion 15, which is limited to the actual hinge body and in which the wall thickness WS—in the present exemplary embodiment of the retaining portion 2 and an adjacent first and second stem portion 4, 4*a* of a first or second wiper arm 3, 3*a*—is reduced by more than 40%, better by more than 60%, see FIG. 5*a*, relative to the wall thickness Wu of the immediate vicinity on both sides—in the present exemplary embodiment of the retaining portion 2 and an adjacent first and second stem portion 4, 4*a* of a first or second wiper arm 3, 3*a*. It is particularly beneficial if the wall thickness (viewed proceeding in the direction of the longitudinal axis L) decreases not substantially continuously, hut is reduced abruptly, as is realized in the exemplary embodiments by the notch E, which, in particular, extends peripherally in the circumferential direction. This fully or possibly substantially perpendicular reduction relative to the longitudinal axis L can be easily recognized in FIGS. 5 and 5*a*. Thus, the result is a pronounced local stress concentration which enhances the effect of the bending moment arising during use, which attempts to pivot the stem portions 4, 4*a* outwards.

Figure 2:
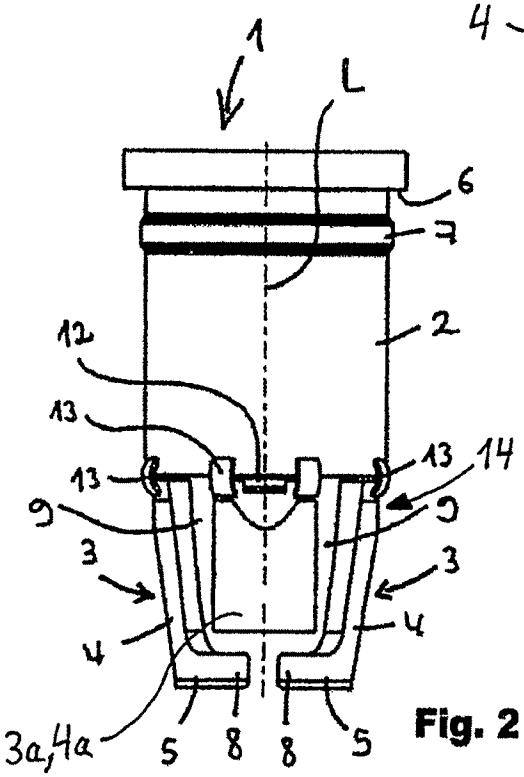
FIG. 2 shows a purely lateral view of the wiper according to FIG. 1.
Figure 3:
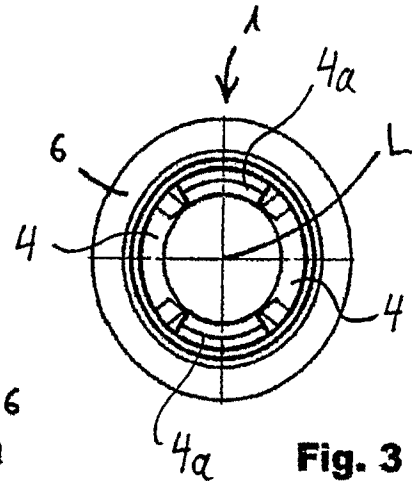
FIG. 3 shows the wiper according to FIG. 1 in a front view, viewed in the direction of the center longitudinal axis, from above.

It may have a favorable effect if the wall thickness of the respective stem portion 4, 4*a* or of a projection 10 is reduced distally below the respectively associated hinge 12. For example in such a way that the result is the local flattened portion 14, which is most frequently plane in the circumferential direction at least at the boundary to the hinge and which is shown in FIGS. 1 and 2. Such a flattened portion 14 allows for a straight connection of the respective hinge (12) to the respective stem portion 4, 4*a* or a respective projection 10—whereby a pivot axis can be realized that is easier to operate because it extends in a more pronouncedly straight manner.

Figure 6:
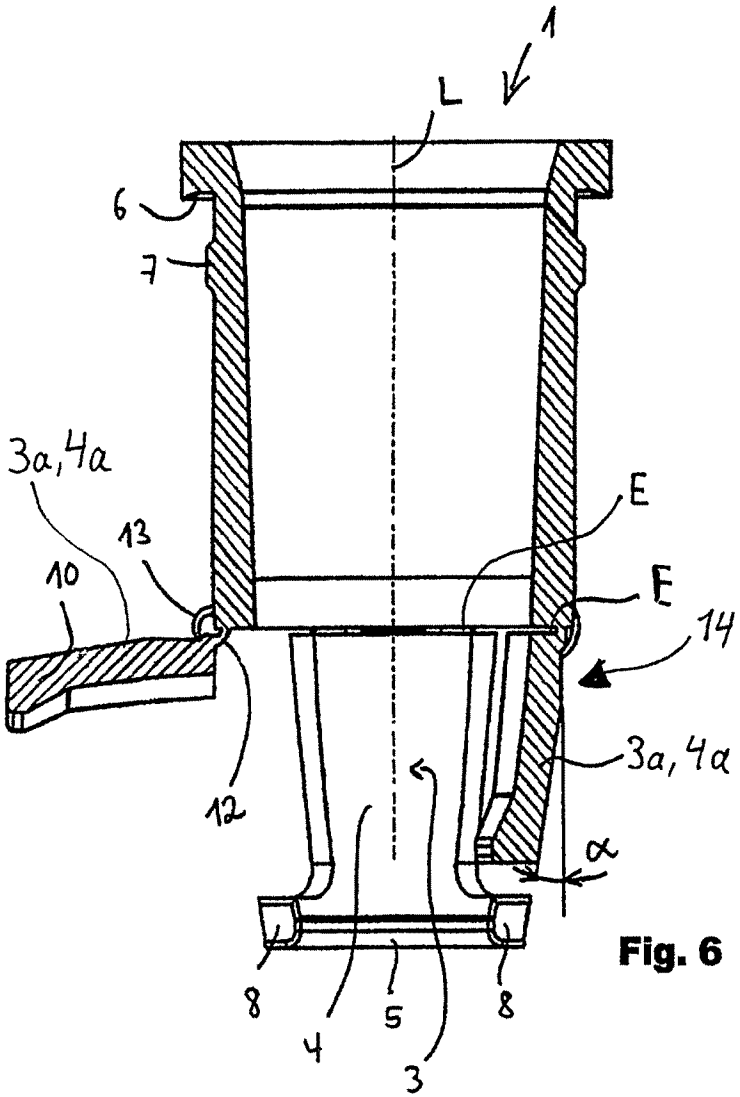
FIG. 6 shows a wiper according to FIG. 1, which has been injection molded in a "folded-out" position for better demolding, and which is then "folded together" and is then ready for use.
Figure 7:
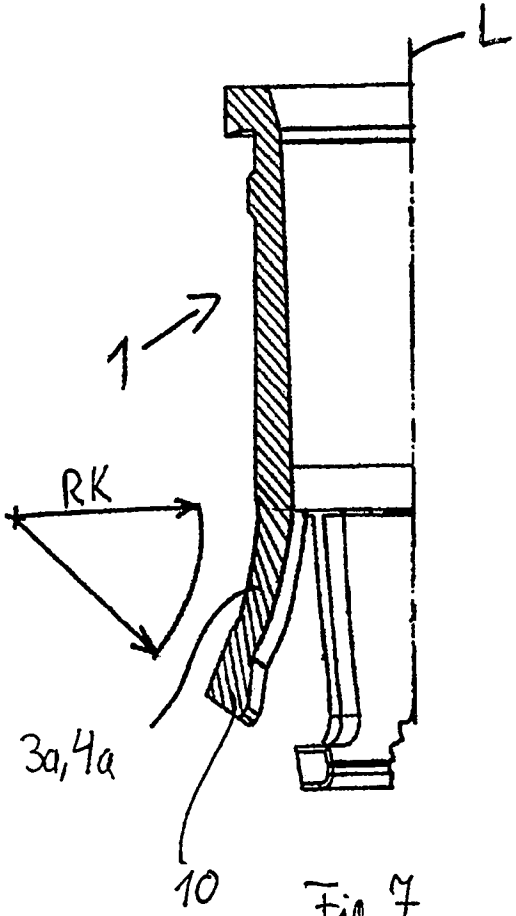
FIG. 7 illustrates what does not come under the term "hinge".
Figure 8:
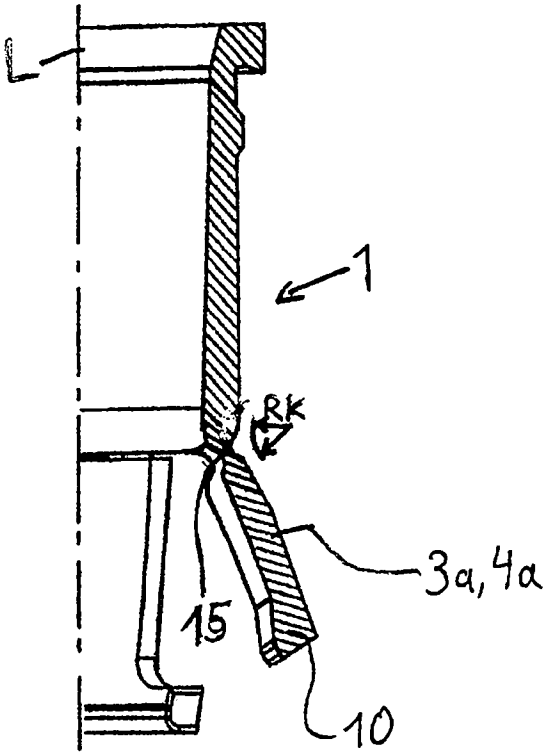
FIG. 8 illustrates what comes under the term hinge.
Figure 10:
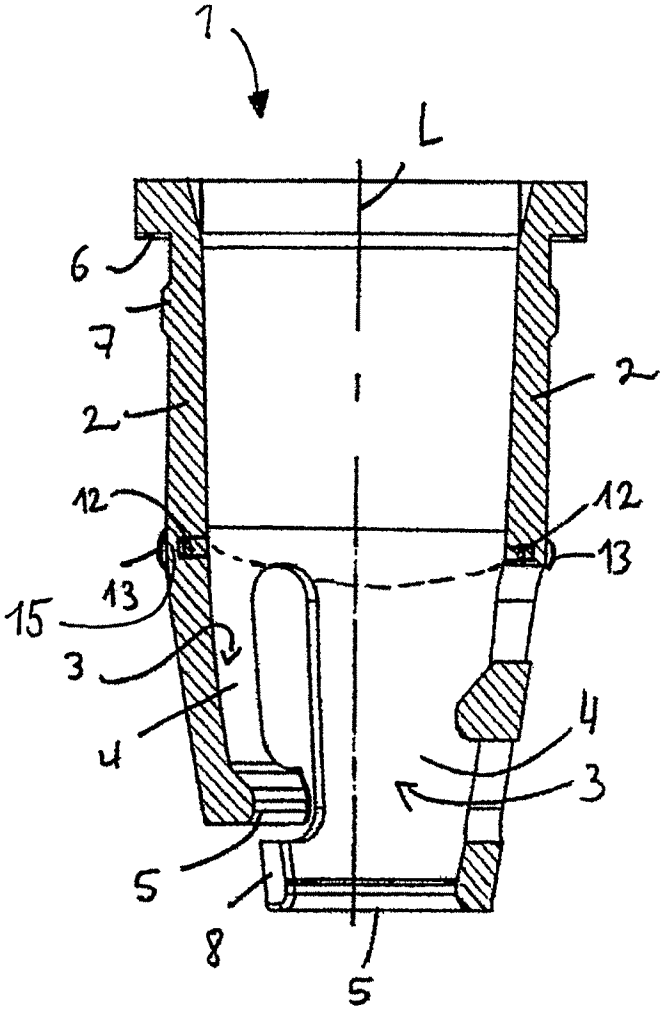
FIG. 10 shows the wiper according to FIG. 9 in a central section along the longitudinal applicator axis.
Figure 9:
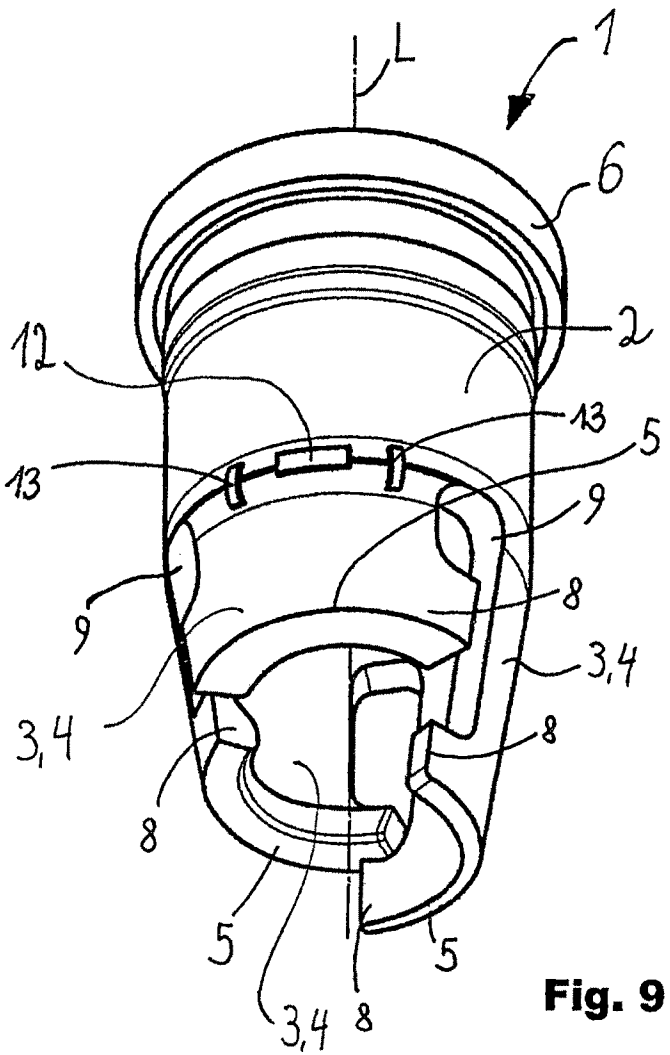
FIG. 9 shows a second exemplary embodiment of a wiper according to the invention in a perspective view from the side, with hinges and spring members that are only indicated.

It is particularly beneficial if all integrally configured hinges 12 that are used on the wiper 1 are configured to be movable in such a way that the first and second stem portions 4 and 4*a* hinge-connected by, means of them to the retaining portion 2 can be folded to the side at an angle of at least 90° (+/−10°) relative of the longitudinal axis L. If they are provided, this also applies to projections 10 if they are also attached by means of a hinge 12. Such a configuration decisively simplifies production, more specifically demolding the finished injection-molded wiper 1 from the injection mold. The comparison of FIGS. 5 and 6 shows the problem in this respect, which is to be overcome:

If the wiper were injection-molded in the position shown by FIG. 5, then the notches E (see FIG. 5*a*) at whose end the film hinge 12 is formed and which form an undercut, which in this case extends perpendicularly to the longitudinal axis L and prevents the possibility of the finished wiper 1 being pushed out from the injection mold by a movement parallel to its longitudinal axis L.

This also applies, mutatis mutandis, to windows 9*a*, 9*b* enclosed by the adjacent stem portions 4 and their ring portions 5, see FIG. 1. If, however, the stem portions 4, 4*a* and also the possibly provided projections 10, which are also hinge-connected, are injection-molded in the position shown in the left-hand partial image of FIG. 6, in which the stem portions 4, 4*a* of the first and second wiper arms 3, 3*a* protrude from the retaining portion 2 of the wiper 1 at least approximately perpendicularly relative to the longitudinal axis L, then the undercuts in the form of the notches E and the windows 9*a*, 9*b* are omitted, and an injection mold suffices which most frequently has to be divided only in a plane transverse or perpendicular to the longitudinal axis L.

This is shown for a second wiper arm 3*a* with a projection 10.

On the other hand, said hinge connection of the stem portions 4, 4*a* and/or of the projections 10 is already very advantageous if the stem portions 4, 4*a* or the projections 10 are injection-molded in the end position shown in the right-hand partial image of FIG. 6, which they assume later on the finished wiper. In that case, the extent of the outer face and the outer contour, which is oriented underneath (distal) in the direction towards the distal end of the wiper 1 at an angle α inwards towards the longitudinal axis L. and the respective hinge 12 allow for a certain temporary deflection of the stem portions 4, 4*a* or of the projections during demolding.

As can be seen, the respective hinge 12, viewed in the circumferential direction, preferably does not extend in each case along the entire stem portion 4, 4*a* or the entire base area of a stem portion 4, 4*a*, but instead has only a limited extent in the circumferential direction, preferably less than 3 mm.

It is particularly beneficial if each stem portion 4, 4*a* has only such a hinge 12 which, viewed in the circumferential direction, is centrally disposed on it, as can be seen in FIG. 1, The statement above generally also applies to the projections 10.

It can also be easily seen from FIGS. 1 and 2 that two spring members 13 are attached to each stem portion 4, 4*a* in addition to the respective hinge 12. They are generally symmetrically positioned to the left and the right next to the respective hinge 12.

The spring, members 13 are preferably each configured as an elastic plastic strip which is integrally connected on its one narrow side to the retaining portion 2 or its area of attachment, and is integrally connected to a stein portion 4, 4*a* of a wiper arm 3, 3*a* on the other side. Each spring member 13 generally brides a gap between the sleeve portion 2 or its area of attachment and the respectively associated stem portion 4, 4*a* or a projection 10, see FIG. 2.

Preferably, each of the spring members 13 is curved in an arc-shaped manner inside and outside. Its thickness in the radial direction is generally smaller than the radial thickness of the wiper 1 itself, most frequently by at least the factor 3, see FIG. 5.

It must now be explained what a stem portion 4, 4*a* is to be understood to be in the narrower sense, and what a further embodiment of the wiper 1 may look like that is not compulsory but beneficial to the invention.

Each of the stem portions 4, 4*a* preferably has a width extending over at least 10%, better over at least 15% of the circumference of the retaining portion 2, where the latter transitions into the stem portions 4, 4*a*. As can best be seen In FIG. 2, each stem portion 4, 4*a* tapers from its point of connection to the retaining portion 2 towards its distal end, and in the first stem portions 4 towards its respective ring portion 5—in the sense that it becomes narrower in the circumferential direction. However, the tapering is preferably configured only sparingly and ideally is less than 20%, better less than 15%, from the proximal end connected to the retaining portion 2 towards the distal end, because only in this manner can it be avoided that the proximal area of the stem portion 4, 4*a* becomes too rigid and/or the distal area too yielding, i.e. that the required uniformity of the bending elasticity is not provided. Preferably, each of the stem portions 4, 4*a* is slightly curved, most frequently in such a way that the outer face of the stem portion 4, 4*a* facing away from the longitudinal axis L is convexly curved in the circumferential direction, and, if necessary, the inner face of the stem portion 4, 4*a* facing towards the longitudinal axis L is also concavely curved in the circumferential direction. Preferably, the stem portions 4, 4*a* are not twisted relative to the longitudinal axis L, in the sense that they wind around the longitudinal axis L like a helical line.

Each of the first stem portions 4 respectively transitions into its ring portion 5 at its distal end.

The entirety of the ring portions 5—which in this first exemplary embodiment are situated in a common plane oriented orthogonally to the longitudinal axis L—forms the actual wiper lip, i.e. the actual area of the wiper 1 that brings about the predominant part of the intended action of the wiper 1 and which, when the applicator is pulled out through the wiper 1, strips off excess cosmetic and most frequently returns it into the storage container, But the lower, distal edge portions of the second wiper arms 3*a* also have such an effect, so that basically, both wiper arms 3, 3*a* form a wiper lip.

As can best be seen in FIG. 2, the extent of each ring portion 5, viewed in the circumferential direction, is greater than the extent of the stem portion 4 carrying the corresponding ring portion 5, also viewed in the circumferential direction. Because the ring portion 5, in each case on both sides of the stem portion 4 associated with it, forms a ring arm 8 which is connected to the central part of the ring portion 5 only unilaterally and protrudes in the circumferential direction towards both sides over the stem portion 4, like a cantilevered beam attached only unilaterally. Preferably, "is greater than" in this case means more than an only inconsiderable amount. Rather, the two ring arms 8 of a ring portion 5 together constitute at least 35%, and better at least 50%, of the length of the entire ring portion 5, viewed in the circumferential direction. They protrude over the stem portion 4 to the corresponding extent. Generally, the free ends of the ring arms 8 are each situated outside the base area of their respective stem portion 4—given a projection in the direction along the outer face of the stem portion(s) 4. Even where the latter does not apply, the ring arms 8 in any case project into the gap formed between two first stem members 4—viewed in a projection along the longitudinal axis L.

The combination of each first stem portion 4 and the ring portion 5 molded onto it is most frequently configured such that it corresponds to the forearm support of a crutch that extends upwards away from the grip.

Figure 4:
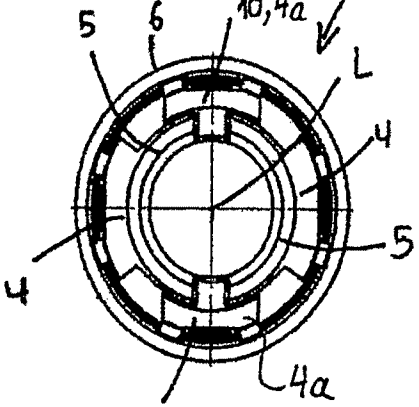
FIG. 4 shows the wiper according to FIG. 1 in a front view, viewed in the direction of the center longitudinal axis, from below.

Generally, each of the first and second stem portions 4, 4*a* is hinge-connected in such a way that it is capable of being displaced in the radially outward direction to a more than just inconsiderable extent. Ideally, the distal end of each stem portion 4, 4*a* is capable of being displaced outwards in the radial direction in an elastically reversible manner, under the forces arising as intended during wiping, by more than 0.8 mm, and better by more than 1.2 mm, particularly where the transition into the ring portion 5 takes place. Thus, the result is a particularly yielding wiper lip which, however, is still able to nestle up very well against the covering of the applicator, due to the configuration of individual parts of the wiper lip as a ring portion. In the preferred exemplary embodiment shown here, two first wiper arms 3 with one ring portion 5 each are provided. Together, these two ring portions 5 form an almost complete circle (see FIGS. 1 and 4), that is, they cover preferably at least 300° of a full circle, with a coverage of at least 330° being extremely desirable.

It can be clearly seen that the ring arms 8 and the rest of the associated ring portion 5 each form a common plane distal end face.

Ideally, the ring arms 8 and the rest of a respectively associated ring portion 5 and preferably also the outer face of the stem portions 4 have an identical curvature in the circumferential direction.

It must also be noted that the ring arms 8 are configured to be very narrow also in the direction parallel to the longitudinal axis L; their maximum extent DR in this direction is preferably 3.5 mm, better only 2.5 mm, see FIG. 5.

Since the wiper 1 is generally formed from an elastic plastic, the ring arms 8 therefore are capable of being displaced outwards in the radial direction to a more than inconsiderable extent relative to the stem portion 4 under the load arising as intended during wiping. A more than just inconsiderable displacement in this case is understood to mean the displacement that is inherently inevitable due to the intrinsic elasticity in every body. A more than just inconsiderable displacement is therefore understood to mean a displacement of at least 0.8 mm, better of at least 1.5 mm.

It can also be easily seen in FIG. 1 that a window 9*a*, 9 that connects the interior, which is otherwise enclosed by the wiper 1 in the circumferential direction, with the space on the circumferential outer face, is enclosed by two adjacent ring portions 5, the associated stem portions 4 and the retaining portion 2. Such a window precludes the otherwise dreaded "blob effect".

Preferably, a projection 10, which is a component of a second wiper arm 3*a* that is connected on its one side to the retaining portion 2 and projects therefrom like a cantilever beam, protrudes into this window. In this case, the extent of each second stem portion 4*a* of each second wiper arm 3*a* with the projection 10, seen in the circumferential direction, is smaller than the extent of each stem portion 4. Preferably, the second wiper arm 3*a* has a constant or at least substantially constant width (+/−7.5%) in the circumferential direction along its entire extent in the direction of the longitudinal axis.

The hinge connection of the second wiper arm 3*a* having the projection 10 to the retaining portion 2 by means of a hinge 12 contributes to the second wiper arm 3*a* having the projection 10 being able to be displaced in the radially outward direction in a reversibly-flexible manner to a more than inconsiderable extent under the influence of the forces arising as intended during the application. In any case, "more than just inconsiderable" means a displacement of the free distal end of the projection by at least 0.7 mm, better yet by at least 1 mm.

In this case, the second wiper arm 3*a* having the projection 10 far from totally covers the surface of the window 9*a*, 9, which as such is free. As can easily be seen in FIG. 1, at least 45%, better still at least 55% of the imaginary window surface area actually remain free.

In any case, the second wiper arm 3*a* has the task of acting as an "auxiliary wiper" for the applicator stem by wiping the narrow area of the stem that otherwise passes the gap between two immediately adjacent ring arms 8 without being wiped off, i.e. being freed from the cosmetic adhering to it; see FIG. 1 that illustrates this. Thus, the second wiper arm 3*a* ensures that the entire circumference of the stem is wiped off.

Optionally, the second wiper arm 3*a* can be given the function—provided it is designed accordingly—of providing for a lateral guidance of the applicator covering, generally a bristle covering, particularly during the reinsertion of the applicator, so that the covering is able to again pass the ring portions 5 and in particular their ring arms 8 without being bent all too sharply or even get caught in the freely cantilevered ring arms 8 in an unfavorable manner. According to the invention, means (in this case in the form of the second wiper arms 3*a* carrying the projections 10) are provided that cause a stem coverage of at least, and better more, than 360°, so that the stem is wiped clean all over.

Viewed in the direction of the longitudinal axis L in a viewing direction oriented towards the distal end, the second wiper arm 3*a* ends above the ring portions 5 of the first wiper arms 3, Preferably, the ring portions 5 reach across the distal end of the second wiper arms 3*a*, viewed in the circumferential direction, without touching them, which promotes the above-mentioned effect. As can easily be seen from the comparison of FIG. 1 and FIG. 2, the wiper according to the invention preferably has two second wiper arms 3*a*, and thus generally also two windows 9, 9*a*.

Taking a very close look, it is possible to see in FIG. 5 that preferably each second wiper arm 3*a* carries on its distal end a projection 10 protruding inwards in the radial direction with a lip 11, which protrudes radially inwards on its distal end and which preferably contributes to the wiping result.

In many cases, the retaining portion 2 will have a stop collar 6 with which it rests against the front face of a container opening in the finished state. Furthermore, the retaining portion 2 will often have a hitching means that enables its positive fixation in the interior of the container opening, where a complementary latching means can be found. In the present exemplary embodiment, the latching means is configured as a latching bead 7.

Preferably, the wiper 1 is divided into two portions, seen in the direction of its longitudinal axis L Said retaining portion 2 forms the first portion of the wiper 1. The second portion of the wiper consists of the first or second wiper arms 3, 3*a*. In the direction of the longitudinal axis L, the first and second portions preferably have the same or approximately the same length with a difference of up to 30%.

The second portion of the wiper 1 is preferably configured, to be conical or inclined, as shown in FIG. 1. A cone angle $\alpha$ of 7.5° to 15° relative to the longitudinal wiper axis L is particularly useful, see FIG. 6.

As can be seen, the retaining portion 2 transitions into preferably at least two first stem portions 4 and two second stem portions 4*a*, which protrude from it like unilaterally connected cantilever beams in the direction substantially parallel to the longitudinal axis L.

FIGS. 8 to 11 show a second exemplary embodiment of the invention.

The hinges 12 and the spring, members 13 are in this case only indicated by a dashed line, they are not drawn in. However, they have the exact same shape as the hinges 12 and the spring members 13 shown by FIGS. 1 to 5.

This wiper 1 is also constructed from two portions, one of which is the retaining portion 2 already described in detail above—in this respect, the first and second exemplary embodiments are identical.

The second portion, whose length is marked by the distal end of the longest second wiper arm 3, is of equal or substantially equal length as the retaining portion 2 also in this case.

However, the second portion is in this case formed by at least three, and preferably only three, first wiper arms 3.

For every individual first wiper arm 3 as such and its components as such, the statements above pertaining to the first wiper arms 3 apply. In particular, however, each wiper arm 3 consists of a stem portion 4 having a ring portion 5 comprising two ring arms 8, which protrude in the circumferential direction over the respective stem portion 4 like unilaterally connected cantilevered beams. Preferably, the lengths of the ring portions 5 in the circumferential direction are the same also in this exemplary embodiment.

The first wiper arms 3 of this exemplary embodiment, however, differ from those of the first exemplary embodiment in that they all have a different length in the direction of the longitudinal wiper axis L. Thus, the ring portions 8 of the first wiper arms 3 form a kind of staircase. Proceeding in a direction from the lowermost ring portion 5 in the circumferential direction, then the next ring member 5 that can be found immediately adjacent is in each case positioned a bit above the preceding ring member 5, until the shortest wiper arm 3 has been reached, to which the longest wiper arm is then directly adjacent, proceeding in the same circumferential direction.

Directly adjacent ring members 5 preferably overlap, most frequently without touching each other. This means that ring arms 8 of two directly adjacent wiper arms 3 lie on top of each other, at least partially, along the longitudinal wiper axis L.

Preferably, a narrow gap, which ideally increases in size in the vicinity of the retaining ring 2, where only the two stem portions 4 are directly adjacent, remains free between every ring arm 8 of a wiper arm 3 and the stem portion 4 of the directly adjacent longer wiper arm 3. Preferably, a window 9 therefore preferably remains free between two directly adjacent wiper arms 3, whose shape can preferably be described as the "shape of the digit 6" and/or the "shape of a mirror-inverted digit 6".

As can be seen rather well, the longest and the shortest stem portions 4 differ in their lengths in the direction parallel to the longitudinal axis L by about 50%, preferably by 50%+/−5%.

The invention claimed is:

1. A wiper for wiping off a cosmetics applicator, comprising:

a retaining portion for fixing the wiper to a cosmetics storage container;

at least two wiper arms that are disposed on the retaining portion and exert a wiping action, wherein at least one of the wiper arms is attached to the retaining portion by at least one hinge, and at least one of the wiper arms has a stem portion with a ring portion molded onto a distal end of the at least one wiper arm, with an extent of the ring portion in a circumferential direction greater than an extent of the stem portion; and at least one spring, member, which presses a respective one of the at least two wiper arms in a direction of a closed position of the respective one of the at least two wiper arms, is associated with the at least one hinge.

2. The wiper according to claim 1, wherein the at least one hinge is a local thin portion.

3. The wiper according to claim 1, wherein the at least one hinge is a film hinge.

4. The wiper according to claim 1, wherein the at least one spring member is an elastic strip, which, relative to a longitudinal wiper axis and in a direction towards a distal end of the wiper, is linked to the retaining portion in front of the at least one hinge and, behind the respective hinge, to the wiper arm.

5. The wiper according to claim 4, wherein the at least one spring member has a curvature whose center of curvature is situated between the at least one spring member and the longitudinal wiper axis.

6. The wiper according to claim 1, wherein at least one of the wiper arms is configured to be folded outwards over an angle of at least 90° relative to a longitudinal wiper axis.

7. The wiper according to claim 1, wherein the wiper is produced by injection molding or by a 3D printing method.

8. A method for producing the wiper according to claim 1, the method comprising:

injection molding the wiper in such a way that the at least two wiper arms exerting a wiping action and the retaining portion are injection-molded in a folded-out position relative to each other, which does not correspond to a position that the retaining portion and the at least two wiper arms exerting a wiping action assume relative to each other during an intended use of the wiper, wherein the at least two wiper arms exerting a wiping action are each connected to the retaining portion by the at least one hinge, and the at least two wiper arms exerting a wiping action, after demolding the wiper from an injection-molding tool, pivot relative to each other and to the retaining portion, into the position that, they assume relative to each other during the intended use of the wiper when free from load.

9. A method for producing the wiper according to claim 1, the method comprising:

injection molding the wiper in such a way that the at least two wiper arms exerting a wiping action and the retaining portion are injection-molded in a position relative to each other which at least substantially corresponds to a position that the retaining portion and the at least two wiper arms exerting a wiping action assume relative to each other during an intended use of the wiper, wherein the at least two wiper arms exerting a wiping action are each connected to the retaining portion by the at least one hinge, and the at least one hinge enables at least a slight pivoting of the respectively hinge-connected wiper arm during a demolding of the wiper from an injection-molding tool.

10. A cosmetics unit comprising a cosmetics storage container, an applicator, a closure cap and a wiper, which is mounted in a neck or a removal opening of the cosmetics storage container, for wiping off cosmetic mass from the applicator, the wiper being configured in accordance with claim 1.

11. A wiper for wiping off a cosmetics applicator, comprising:

a retaining portion for fixing the wiper to a cosmetics storage container;

at least two wiper arms that are disposed on the retaining portion and exert a wiping action, wherein at least one of the wiper arms is attached to the retaining portion by at least one hinge, and each of the wiper arms is joint-connected to the retaining portion by only a single one of the at least one hinge, wherein the single hinge, relative to an extent of a respectively associated wiper arm in a circumferential direction, is disposed centrally on the respectively associated wiper arm; and at least one spring member, which presses a respective one of the at least two wiper arms in a direction of a closed position of the respective one of the at least two wiper arms, is associated with the at least one hinge.

12. A wiper for wiping off a cosmetics applicator, comprising:

a retaining portion for fixing the wiper to a cosmetics storage container;

at least two wiper arms that are disposed on the retaining portion and exert a wiping action, wherein at least one of the wiper arms is attached to the retaining portion by at least one hinge, and each of the wiper arms is joint-connected to the retaining portion by a single one of the at least one hinge, wherein the single hinge, relative to an extent of a respectively associated wiper arm in a circumferential direction, is disposed centrally on the respectively associated wiper arm, and wherein a single one of the at least one hinge, viewed in the circumferential direction, is centrally situated on each wiper arm, and, viewed in the circumferential direction, one spring member, respectively, is disposed on each side of the single respective hinge on each wiper arm.

* * * * *